United States Patent [19]

Noll

[11] Patent Number: 4,981,247

[45] Date of Patent: Jan. 1, 1991

[54] PROTECTIVE COVER FOR AN ELECTRIC STAPLER

[75] Inventor: Richard C. Noll, 2218 Airline, Toledo, Ohio 43609

[73] Assignees: Richard C. Noll, Toledo; John E. Phalen, Jr., Sylvania, both of Ohio

[21] Appl. No.: 381,059

[22] Filed: Jul. 17, 1989

[51] Int. Cl.[5] ..... B25C 7/00

[52] U.S. Cl. ..... 227/156; 150/161

[58] Field of Search ..... 227/156; 173/171, DIG. 2; 181/200, 203, 205; 150/161

[56] References Cited

U.S. PATENT DOCUMENTS 1,115,704 11/1914 Manes ..... 173/DIG. 2 X
2,949,975 8/1960 Plummer ..... 173/DIG. 2 X
3,757,891 9/1973 Krieger ..... 181/205
4,774,930 10/1988 Sellers ..... 225/96.5 X
4,892,413 1/1990 Vats ..... 181/200 X

*Primary Examiner*—Frank T. Yost
*Assistant Examiner*—Rinaldi Rada
*Attorney, Agent, or Firm*—Macmillan, Sobanski & Todd

[57] ABSTRACT

A protective cover for securing to the power head of an electric stapler of the type used for carpet installation. The cover is formed from a sheet of resilient material such as leather. The cover wraps around the power head and is secured by two pairs of snaps, for example. The cover is shaped to substantially conform with the shape of the power head.

7 Claims, 2 Drawing Sheets

PROTECTIVE COVER FOR AN ELECTRIC STAPLER

TECHNICAL FIELD

This invention relates to electric staplers and more particularly to a protective cover for an electric stapler of the type used, for example, in carpet installation.

BACKGROUND ART

Electric staplers or tackers are used for many industrial and commercial applications, such as for carpet installation. In installing carpet, staples are commonly used to hold carpet on stairs, for example, and at other places where other types of fasteners such as tack strips are not suitable. The typical electric stapler or tacker has a power head including a staple applying end, a mechanism for feeding staples to the power head, a handle and a trigger for actuating the stapler. The handle and the staple feeding mechanism extend from one side of the power head. For carpet staplers, the power head tapers to relative small dimensions at the staple applying end to permit stapling close to walls, baseboards, steps, etc. A common problem with use of such staplers is in marring the walls, baseboards, and other finished trim adjacent to where the carpet is being stapled. Marring is a problem because it is desirable to apply staples as closely as possible to the walls, etc., and the power head is made from a hard material. To date, there has been no effective means for protecting adjacent walls, baseboards and the like while stapling carpet to a floor. A shield could be held between the stapler and the wall. However, the carpet installer may not have a free hand for holding the shield and the use of a shield would slow down the carpet installer.

DISCLOSURE OF INVENTION

According to the invention, a protective cover is provided for a conventional electric stapler or tacker to prevent marring adjacent walls, baseboards, trim and the like when stapling, for example, carpet to a floor or a step. The protective cover is formed from a flat sheet of tough but resilient material, such as leather. The sheet is wrapped around the power head of the stapler and is releasably secured in place with snaps, Velcro strips, or the like. The sheet is shaped to substantially conform to the shape of the power head and is provided with a recessed area to pass the handle. Further, the sheet may be shaped by cutting a V-shaped groove in an edge portion which is adjacent the staple applying end of the power head. The free ends of the groove are secured together to reduce the size of the cover adjacent the staple applying end of the power head.

Accordingly, it is an object of the invention to provide a protective cover for an electric stapler to reduce the likelihood of marring adjacent surfaces when applying staples.

Other objects and advantages of the invention will be apparent from the following detailed description and the accompanying drawings.

BEST MODE FOR CARRYING OUT THE INVENTION

Figure 1:
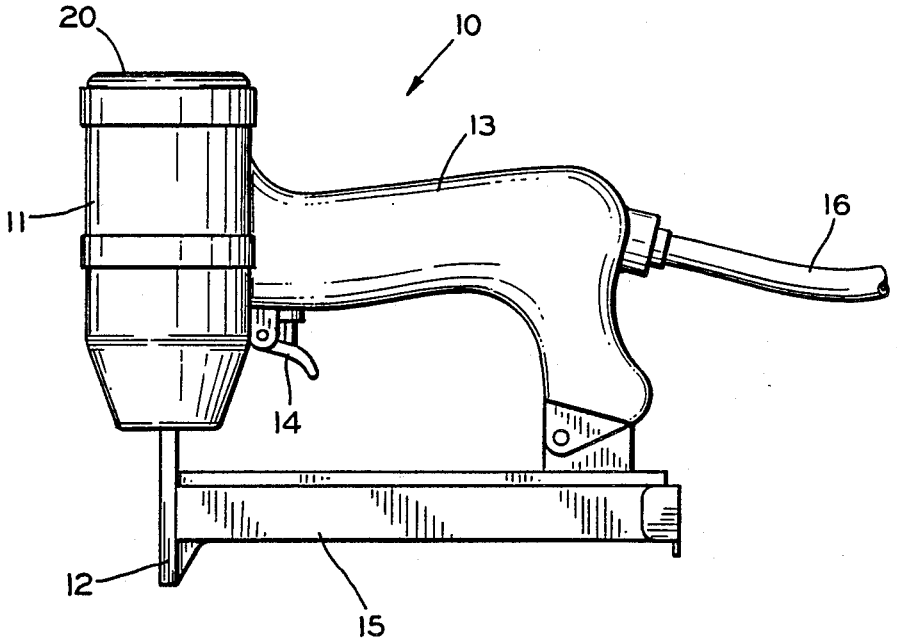
FIG. 1 is a side elevational view of a conventional carpet stapler or tacker.

Turning to the drawings and particularly to FIG. 1, an electric stapler 10 of the type used for stapling or tacking carpet is illustrated. The stapler 10 has a power head 11 terminating at a staple applying end 12, a handle 13, a trigger 14 and a staple feeding mechanism 15. A fragmentary portion of a power cord 16 also is illustrated. The handle 13 projects from one side of the power head 11. The staple feeding mechanism 15 projects from the same side of the staple feeding mechanism 12 and is attached to the handle 13 for strength. The staple feeding mechanism 15 is preferably smaller than the power head 11 to allow stapling close to the edge of a carpet next to a wall, for example.

It should be understood that the stapler 10 shown in FIG. 1 is merely exemplary and that the invention is applicable to other commercially available staplers which may be sold for carpet installation or for applications other than carpet installation. In its broadest aspect, the term "stapler" as used herein is intended to include both wire staple drivers and electric tack and nail drivers of similar design. The stapler 10 may be designed to operated either from an electric wall outlet or from an internal rechargeable battery.

Figure 2:
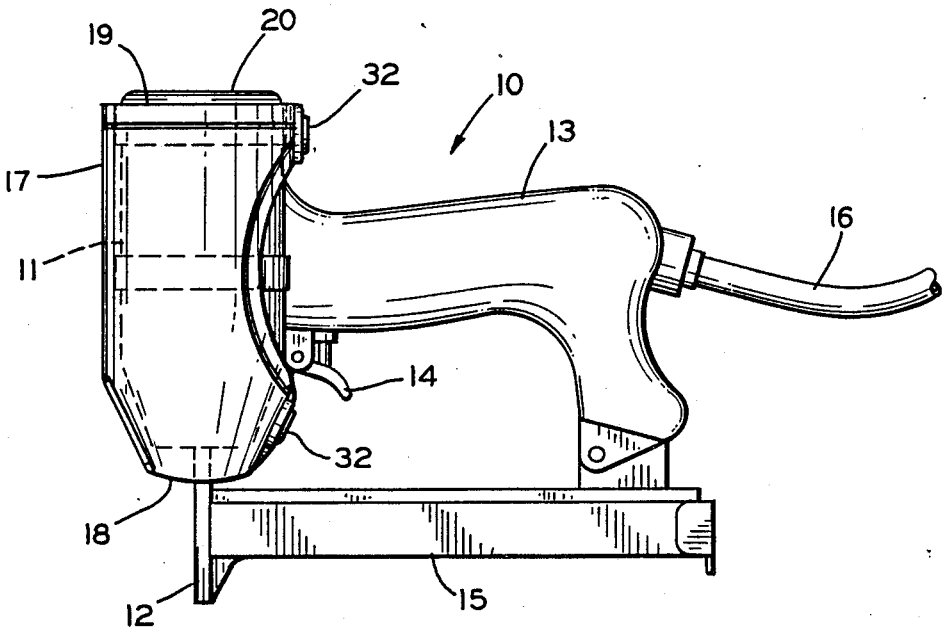
FIG. 2 is a side elevational view of the stapler of FIG. 1 with the protective cover of the invention attached.
Figure 3:
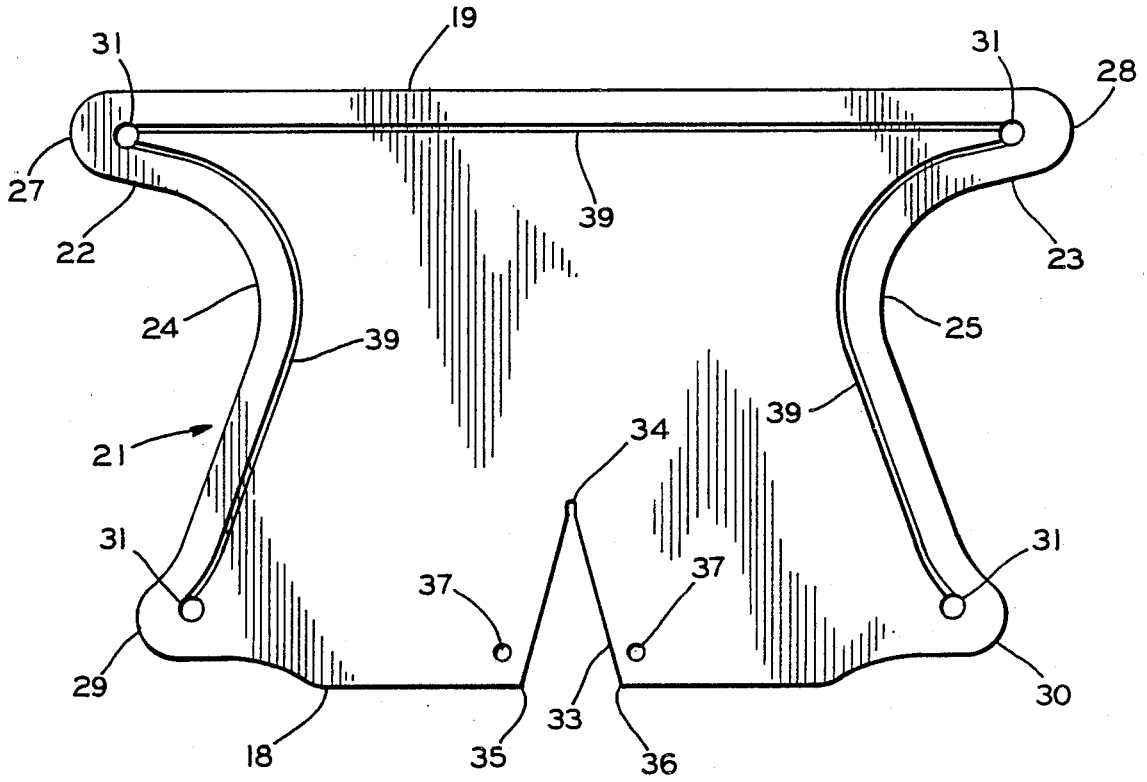
FIG. 3 is a plan view showing the shape that the sheet material is cut to form the protective cover of the invention.

FIG. 2 shows the electric stapler 10 with an attached protective cover 17 according to the invention. The cover 17 fits over the power head 11 to extend from one end 18 adjacent the staple feeding mechanism 15 to an opposite end 19 adjacent a top 20 of the power head 11.

Details of the construction of the protective cover 17 are shown in FIGS. 2–5. The cover 17 is formed from a flat sheet 21 of tough, resilient material having a relatively smooth outer side, such as of cowhide leather of about 0.125 inch thickness or more. However, other materials having similar properties may be used, such as a synthetic leather. In any event, the material should be of a nature which will not mar or mark the finish on walls, stairs, or whatever the power head 11 should contact during normal use.

Figure 5:
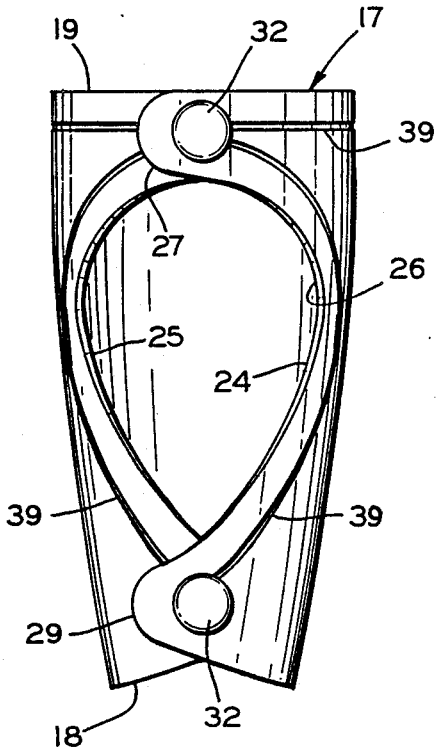
FIG. 5 is a rear elevational view of the protective cover of FIG. 4.

The sheet 21 is shaped to wrap around the power head 11. Between the ends 18 and 19, opposite sides 22 and 23 are shaped with cut out or relieved areas 24 and 25, respectively. When the sheet 21 is wrapped around the stapler power head 11, the relieved areas 24 and 25 form an opening 26, as best seen in FIG. 5, for fitting around the handle 13 and the trigger 14.

The sheet 21 has four corners 27–30. Suitable fasteners are provided for releasably securing the corners 27 and 28 together and for releasably securing the corners 29 and 30 together for attaching the cover 17 to the stapler 10. For example, holes 31 may be formed in the sheet 21 adjacent each of the corners 27–30 for attaching conventional snaps 32. Or, Velcro strips (not shown) may be attached to the corners 27–30 for releasably securing the corners 27 and 28 together and the corners 29 and 30 together. It should be noted that the corners 27–30 may take the form of projecting tabs, as generally illustrated for the corners 27 and 28 or may be more rounded, as illustrated for the corners 29 and 30.

The best shape for the corners 27–30 and for the relieved areas 24 and 25 will vary with the design of the stapler 10 to which the cover 17 will be secured.

Figure 4:
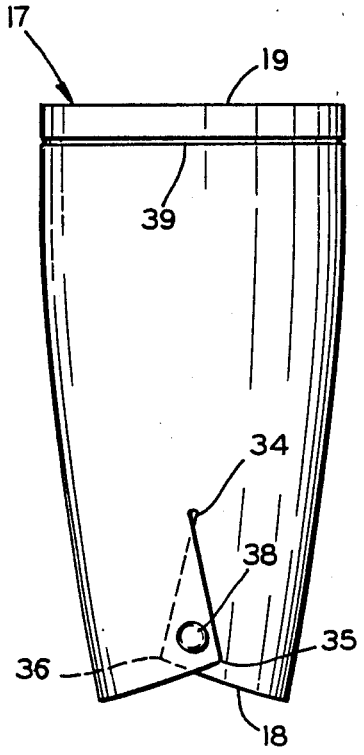
FIG. 4 is a front elevational view of the finished protective cover of the invention.

The sheet 21 is shaped to generally conform with the shape of the stapler power head 11 to which the cover 17 will be secured. If the power head 11 reduces in size at the staple applying end 12, the cover 17 also should reduce in size at the adjacent end 18. The shape of the cover 17 may be reduced at the end 18 by forming the corners 29 and 30 closer together than the corners 27 and 28. The size of the end 18 can be further reduced by forming one or more cuts 33 (one shown) extending inwardly form the end 18. The cut 33 is generally V-shaped and preferably has a rounded inner end 34 and two free ends 35 and 36. The rounded inner end 34 prevents the sheet 21 from tearing at the end 34 during use of the stapler 10. Holes 37 are formed in the sheet 21 adjacent the free ends 35 and 36. As best seen in FIG. 4, the free ends 35 and 36 are overlapped so that the holes 37 align and the free ends 35 and 36 are permanently secured together, for example, by a rivet 38 through the holes 37.

If desired, the cover 17 can be decorated. In the illustrated cover 17, decorative lines 39 are shown carved into the sheet 21 to extend between the pairs of holes 27 and 29, 27 and 28 and 28 and 29. The lines 39 may follow the contours of the adjacent edges of the sheet 21, as illustrated, or may have any other desired decorative appearance.

It will be appreciated that various modifications and changes may be made in the protective cover for an electric stapler without departing from the spirit and the scope of the following claims.

I claim:

1. A protective cover for releasably securing to an electric stapler of the type having a power head including a staple applying end, a mechanism for feeding staples to the power head and a handle projecting from the power head at a location spaced from the staple feeding mechanism, said protective cover comprising a sheet of resilient material shaped to wrap about at least a portion of the power head, first and second pairs of releasable fastener means for securing said cover to the power head when said sheet is wrapped about the power head, said sheet having relieved areas for the stapler handle when said cover is secured to the power head, and wherein said first and second pairs of fasteners extend on opposite sides of the handle with said first pair of fasteners located between the handle and the staple feeding mechanism.

2. A protective cover for releasably securing to an electric stapler, as set forth in claim 1, wherein said sheet of resilient material is of leather.

3. A protective cover for releasably securing to an electric stapler, as set forth in claim 1, wherein said sheet has an integral pair of tabs and wherein said second pair of fasteners are attached to said tabs.

4. A protective cover for releasably securing to an electric stapler, as set forth in claim 3, wherein said first and second pairs of fasteners are snaps.

5. A protective cover for releasably securing to an electric stapler, as set forth in claim 1, wherein said sheet is shaped to substantially conform to the shape of the power head.

6. A protective cover for releasably securing to an electric stapler, as set forth in claim 5, wherein the sheet is shaped by forming at least one v-shaped cut in edge portion of said sheet which is adjacent the staple applying end when said cover is secured to the power head, said sheet having free ends on opposite sides of said cut, and means securing said free ends together to reduce the size of said sheet at said edge portion.

7. A protective cover for releasably securing to an electric stapler, as set forth in claim 6, wherein said sheet is further shaped by positioning said first pair of fasteners on said sheet closer together than said second pair of fasteners to further reduce the size of said sheet at said edge portion.

* * * * *